US006827162B2

(12) United States Patent
Fisher

(10) Patent No.: US 6,827,162 B2
(45) Date of Patent: Dec. 7, 2004

(54) SELF-RETAINING DOWNHOLE-HAMMER DRILL BIT

(75) Inventor: Brandon W. Fisher, Berlin, PA (US)

(73) Assignee: Center Rock, Inc., Berlin, PA (US)

( * ) Notice: Subject to any disclaimer, the term of this patent is extended or adjusted under 35 U.S.C. 154(b) by 68 days.

(21) Appl. No.: 10/283,580

(22) Filed: Oct. 30, 2002

(65) Prior Publication Data

US 2004/0084225 A1 May 6, 2004

(51) Int. Cl.[7] ..... E21B 10/36

(52) U.S. Cl. ..... 175/414; 175/300; 173/132; 403/310

(58) Field of Search ..... 175/414, 300, 175/258, 189, 132, 133; 173/132, 133; 403/11, 204, 218, 310, 311, 377, 410

(56) References Cited

U.S. PATENT DOCUMENTS

| | | | | |
|---|---|---|---|---|
| 50,190 A | * | 9/1865 | Watson | 403/310 |
| 4,694,911 A | | 9/1987 | Kennedy | |
| 5,065,827 A | | 11/1991 | Meyers et al. | |
| 5,454,152 A | * | 10/1995 | Hosseinian | 29/243.518 |
| 5,647,447 A | * | 7/1997 | Jones | 175/300 |
| 5,699,867 A | | 12/1997 | Jones | |
| 5,787,999 A | | 8/1998 | Holte | |
| 6,021,856 A | | 2/2000 | Pascale | |
| 6,070,678 A | * | 6/2000 | Pascale | 175/300 |
| 6,213,230 B1 | | 4/2001 | Fuss | |

* cited by examiner

*Primary Examiner*—David Bagnell
*Assistant Examiner*—K. Thompson
(74) *Attorney, Agent, or Firm*—Akin Gump Strauss Hauer & Feld, LLP

(57) ABSTRACT

The present invention relates to a downhole-hammer drill-bit assembly for removable attachment to a substantially tubular casing of a downhole hammer. The drill-bit assembly has a substantially tubular chuck, a drill-bit, and a substantially tubular retainer. The chuck has a step. The drill-bit has a bit shank, a bit shoulder extending from the shank and a bit head. A 6first portion of the bit shank is in a bore of the chuck. The retainer has a split retainer sidewall, a first end and a second end. The first end has a split retainer collar. The second end has a split retainer ring. The split retainer sidewall is around a portion of the chuck and the bit shoulder. The split retainer collar is around a first surface of the step. The split retainer ring is around a portion of the bit shank between the bit shoulder and the bit head.

8 Claims, 2 Drawing Sheets

SELF-RETAINING DOWNHOLE-HAMMER DRILL BIT

BACKGROUND OF THE INVENTION

The present invention relates to a downhole-hammer drill-bit assembly. More particularly, the present invention relates to a self-retaining drill-bit assembly having a tubular retainer with a split sidewall that aids in the retrieval of a drill-bit that breaks or shanks-off during drilling.

Cyclic fatigue induced crack nucleation and propagation to fracture is a common failure mode for hammer bits. Typically, the fracture occurs in the shank below the retaining ring and above the bit head and results in a complete separation of the bit head from the shank. Recovery of the severed bit head from the bottom of a drill hole often requires a fishing procedure the outcome of which is uncertain and adversely impacts drilling productivity.

Current retention devices typically have a generally one-piece cylindrical collar or sleeve that is placed around a drill-bit shank and that extends axially above and below the portion of the shank where fractures are known to occur. The retention devices are usually attached to various structural elements of the drill bit and drill chuck or drill casing by locking pins or snap rings that can loosen or shear causing damage to a drill string.

A retention device, such as the present invention, that is self-retaining, thereby reducing the number of parts comprising the device and eliminating the potential for damage caused by loose or sheared parts is a significant advancement in downhole-hammer drill bit retention devices.

BRIEF SUMMARY OF THE INVENTION

One aspect of the present invention relates to a downhole-hammer drill-bit assembly for removable attachment to a substantially tubular casing of a downhole hammer. The tubular casing has an axially extending casing bore with an inner diameter. The drill-bit assembly comprises a substantially tubular chuck, a drill-bit and a substantially tubular retainer. The substantially tubular chuck has an axially extending chuck bore and a generally radially outwardly facing surface with a first portion, a second portion, and a step between the first and second portions. The first portion is insertable in the casing bore and removably attachable to the casing. The step has an axially-extending outwardly-facing first surface having an outer diameter less than the inner diameter of the casing bore and a radially outwardly-extending second surface having an outer diameter greater than the inner diameter of the casing bore. The drill-bit has a bit shank with an outer diameter and a bit head. The bit shank has a radially outwardly-extending bit shoulder having an outer diameter greater than the outer diameter of the bit shank. At least a first portion of the bit shank is in the chuck bore. The substantially tubular retainer has a split retainer sidewall, a first end and a second end. The split retainer sidewall is around the second portion of the chuck and around the bit shoulder. The first end has a radially inwardly-extending retainer shoulder with an axially-extending first lip forming a split retainer collar having an outer diameter less than the inner diameter of the casing bore and an inner diameter greater than the outer diameter of the first surface of the step. The split retainer collar is around the first surface of the step. The second end has a radially inwardly-extending second lip forming a split retainer ring having an inner diameter less than the outer diameter of the bit shoulder. The split retainer ring is around a second portion of the bit shank between the bit shoulder and the bit head.

Another aspect of the present invention is a method for retaining a severed downhole-hammer drill bit, comprising the steps of inserting a drill bit in a bore of a tubular chuck, placing around a portion of the chuck and a portion of the drill-bit a tubular retainer having a split sidewall, a split ring and a split collar such that the split ring is below a shoulder of a shank of the drill bit and the split collar is above the shoulder and securing the chuck to a drill casing such that the split collar is retained between a radially outwardly facing surface of the chuck and a radially inwardly facing surface of the drill casing.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Certain terminology is used in the following description for convenience only and is not limiting. The words "inwardly" and "outwardly" refer to directions toward and away from, respectively, the geometric center of the downhole-hammer drill-bit assembly and designated parts thereof. The terminology includes the words above specifically mentioned, derivatives thereof and words of similar import.

Additionally, as used in the claims and in the corresponding portion of the specification, the word "a" means "at least one". Further, unless otherwise defined the word "about" when used in conjunction with a numerical value means a range of values corresponding to the numerical value plus or minus ten percent of the numerical value. Still further, the word "or" has the meaning of a Boolean inclusive "Or". For example, the phrase "A or B" means "A" alone or "B" alone or both "A" and "B".

Figure 1:
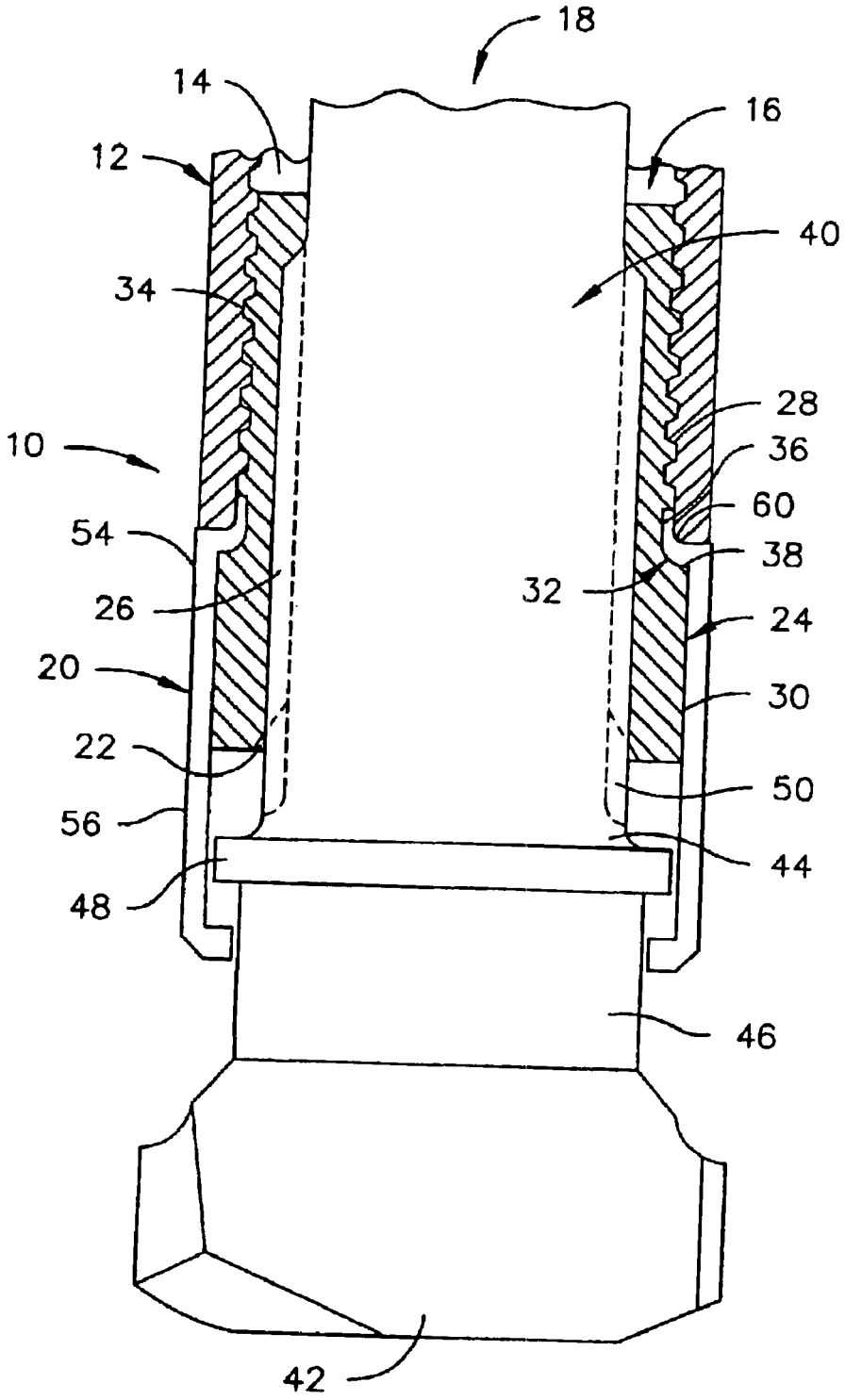
FIG. 1 is a cross-sectional elevation view of a portion of a downhole-hammer drill-bit assembly in accordance with a first preferred embodiment of the present invention.
Figure 2:
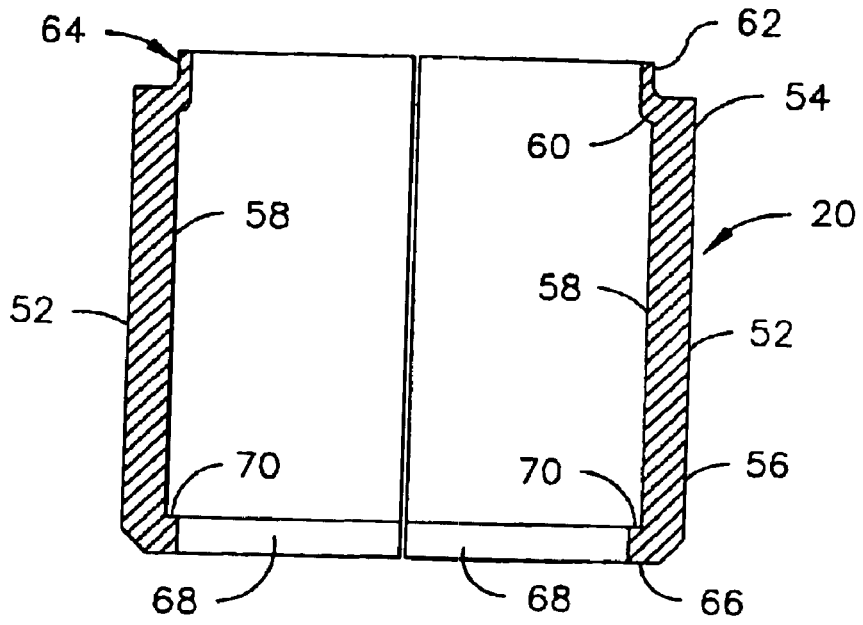
FIG. 2 is a cross-sectional elevation view of the tubular retainer of FIG. 1.
Figure 3:
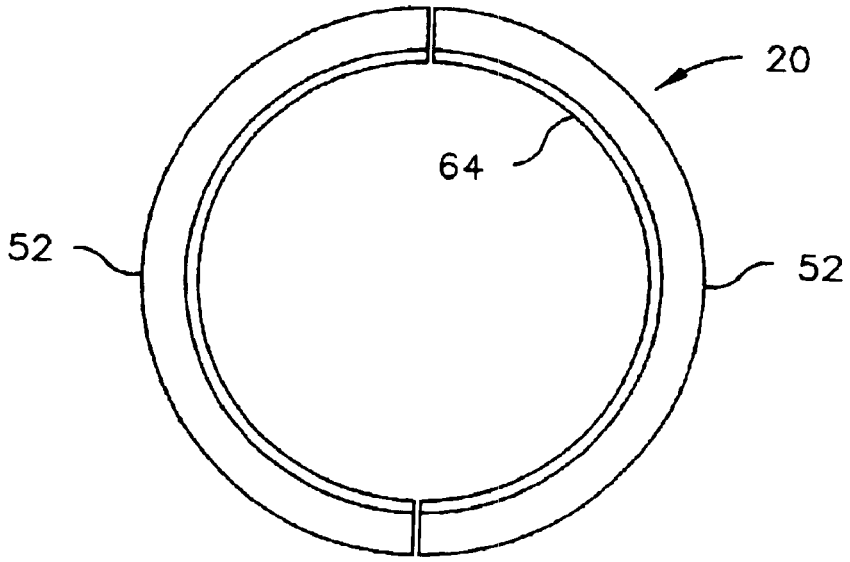
FIG. 3 is a top plan view of the tubular retainer of FIG. 1.

Referring to the drawings in detail, where like numerals indicate like elements throughout there is shown in FIGS. 1–3 a first preferred embodiment of the downhole-hammer drill-bit assembly generally designated 10, and hereinafter referred to as the "Drill-Bit Assembly" 10, in accordance with the present invention. The Drill-Bit Assembly 10 is for removable attachment to a substantially tubular casing 12 of a downhole hammer (not shown). The Drill-Bit Assembly 10 comprises a substantially tubular chuck 16, a drill-bit 18, and a substantially tubular retainer 20.

The tubular casing 12 to which the Drill-Bit Assembly 10 is removably attachable can be any conventional, drill casing well known in the drilling industry. The tubular casing 12 has an outer diameter and an axially extending casing bore 14 with a radially inwardly facing surface 15 having an inner diameter. Typically, the outer diameter of the casing 12 ranges from about four inch to about twelve inch, and preferably is about seven inch. The inner diameter of the surface 15 of the casing bore 14 ranges from about three inch to about eleven inch, and preferably is about six inch.

The substantially tubular chuck 16 has an axially extending chuck bore 22 and a generally radially outwardly facing surface 24. The chuck bore 22 has an axially and radially inwardly extending key 26. Preferably, but not necessarily, the chuck bore 22 as a plurality of axially-extending keys equidistantly spaced about the circumference of the outwardly facing surface 24. The radially outwardly facing surface 24 has a first portion 28, a second portion 30, and a step 32 between the first and second portions 28, 30. The first portion 28 is insertable in the casing bore 14. Preferably, but not necessarily, a first portion 34 of the casing bore 14 is threadedly attachable to the casing 12.

The step 32 has a first surface 36 and a second surface 38. The first surface 36 is an axially-extending outwardly-facing surface having an outer diameter that is less than the inner diameter of the casing bore 14. Preferably, the first surface 36 has an axial extent of about one inch. The second surface 38 is a radially outwardly-extending surface having an outer diameter greater than the inner diameter of the casing bore 14 and less than the outer diameter of the casing 12. Preferably, the second surface 38 has a radial extent of about one inch. Those of ordinary skill in the art will understand from this disclosure that the dimensions of the step 32 may vary with the size of the drill casing as may the dimensions of the corresponding structure of the retainer 20 discussed below.

The drill-bit 18 has a bit shank 40 and a bit head 42. The bit shank 40 has an outer diameter that typically ranges from about three inch to about eleven inch and preferably is about six inch. The bit shank 40 has a first portion 44, a second portion 46 and a bit shoulder 48. The first portion 44 of the bit shank 40 is insertable in the chuck bore 18 and slideable therein. Preferably, the first portion 44 has at least one axially-extending keyway 50 engageable with the key 26 of the chuck 16 and may have a plurality of keyways corresponding to the keys of a chuck having a plurality of keys.

The bit shoulder 48 is between the first and second portions 44, 46 of the bit shank 40 and extends radially outwardly. The bit shoulder 48 has an outer diameter that is greater than the outer diameter of the bit shank 40 and less than the inner diameter of the retainer 20 discussed below. Preferably, the bit shoulder 48 has a radial extent of about one-fourth inch and is spaced about five inch from the drill bit head 42.

Referring to FIGS. 2–3, the substantially tubular retainer 20 has a split retainer sidewall 52, a first end 54 and a second end 56. The split retainer sidewall 52 has a radially inwardly facing surface 58 around the second portion 46 of the chuck 16 and around the bit shoulder 48. The first end 54 of the tubular retainer 20 has a radially inwardly-extending retainer shoulder 60. The retainer shoulder 60 has an axially-extending first lip 62 that forms a split retainer collar 64. The first lip 32 has an axial extent that corresponds to the axial extent of the first surface 36 of the step 32 of the chuck 16 and is preferably about one-half inch.

The split retainer collar 64 has an outer diameter that is less than the inner diameter of the casing bore 14 and an inner diameter that is greater than the outer diameter of the first surface 36 of the step 32. The split retainer collar 64 is around the first surface 36 of the step 32.

The second end 56 of the tubular retainer 20 has a radially inwardly-extending second lip 66 forming a split retainer ring 68 having an inner diameter less than the outer diameter of the bit shoulder 48. Preferably, the second lip 66 has a radial extent of about one-fourth inch. The second lip 66 has a retainer surface 70 at an acute angle relative to the radially inwardly facing surface 58 of the split retainer sidewall 52. Preferably, the acute angle is about eighty degrees. The split retainer ring 68 is around the second portion 46 of the bit shank 40.

Those skilled in the art will understand from the above disclosure that the dimensions stated herein are not limiting and that they may vary depending upon the intended drilling application and the materials from which the Drill-Bit Assembly 10 is made. Typically, steel is the preferred material for all elements of the invention. However, other metals, composites and polymeric materials may be used without departing from the scope and spirit of the invention.

In use, the Drill Bit Assembly 10 is preferably assembled and removably attached to a tubular drill casing in the manner that follows. The first portion 44 of the bit shank 40 of the drill bit 18 is inserted in the bore 22 of the chuck 16 such that the key 26 protruding into the chuck bore 22 is in registry with the corresponding keyway 50 in the first portion 44 of the bit shank 40.

The split sidewall 53, the split ring 68 and the split collar 64 of the tubular retainer 20 are placed around a portion of the chuck 16 and a portion of the drill bit 18 such that the split ring 68 is below the shoulder 48 of the shank 40 of the drill bit 18 and the split collar 64 is above the shoulder 48. The retainer 20 is positioned axially with respect to the chuck 16 such that the retainer shoulder 60 is in registry with the step 32 of the chuck.

With the tubular retainer 20 in the aforementioned position, both the first portion 44 of the bit shank 40 and the first portion 28 of the radially outwardly facing surface 24 of the chuck 16 are inserted in the casing bore 14, such that the split retainer collar 64 is in the casing bore 14. Rotation of the drill bit 18 threadedly secures the chuck 16 to the casing 12, thereby retaining the split collar 64 between the radially outwardly facing surface 24 of the chuck 16 and the radially inwardly facing surface 15 of the tubular casing bore 14.

Those skilled in the art will appreciate that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A downhole-hammer drill-bit assembly for removable attachment to a substantially tubular casing of a downhole hammer, the tubular casing having an axially extending casing bore with an inner diameter, the drill-bit assembly comprising:

a substantially tubular chuck having an axially extending chuck bore and a generally radially outwardly facing surface with a first portion, a second portion, and a step between the first and second portions, the first portion insertable in the casing bore and removably attachable to the casing, the step having an axially-extending outwardly-facing first surface having an outer diameter less than the inner diameter of the casing bore and a radially outwardly-extending second surface having an outer diameter greater than the inner diameter of the casing bore;

a drill-bit having a bit shank with an outer diameter and a bit head, the bit shank having a radially outwardly-extending bit shoulder having an outer diameter greater than the outer diameter of the bit shank, at least a first portion of the bit shank in the chuck bore; and a substantially tubular retainer having a split retainer sidewall, a first end and a second end, the split retainer sidewall around the second portion of the chuck and around the bit shoulder, the first end having a radially inwardly-extending retainer shoulder with an axially-extending first lip forming a split retainer collar having an outer diameter less than the inner diameter of the casing bore and an inner diameter greater than the outer diameter of the first surface of the step, the split retainer collar around the first surface of the step, the second end having a radially inwardly-extending second lip forming a split retainer ring having an inner diameter less than the outer diameter of the bit shoulder, the split retainer ring around a second portion of the bit shank between the bit shoulder and the bit head.

2. The downhole-hammer drill-bit assembly according to claim 1, wherein the outer diameter of the second surface of the step is less than an outer diameter of the casing.

3. The downhole-hammer drill-bit assembly according to claim 1, wherein the first portion of the radially outwardly facing surface of the chuck has threads.

4. The downhole-hammer drill-bit assembly according to claim 1, wherein the first portion of the bit shank has at least one axially-extending keyway and the chuck has at least one axially-extending key engageable with the at least one keyway.

5. The downhole-hammer drill-bit assembly according to claim 1, wherein the outer diameter of the second surface of the step is less than an outer diameter of the casing, the first portion of the radially outwardly facing surface of the chuck is threaded, the first portion of the bit shank has at least one axially-extending keyway, and the chuck has at least one axially-extending key engageable with the at least one keyway.

6. The downhole-hammer drill-bit assembly according to claim 1, wherein the second lip has a retainer surface at an acute angle relative to a radially inwardly facing surface of the split retainer sidewall.

7. The downhole-hammer drill-bit assembly according to claim 6, wherein the acute angle is about eighty degrees.

8. A downhole-hammer drill-bit assembly for removable attachment to a substantially tubular casing of a downhole hammer, the tubular casing having an outer diameter and an axially extending casing bore with an inner diameter, the drill-bit assembly comprising:

a substantially tubular chuck having an axially extending chuck bore and a generally radially outwardly facing surface, the chuck bore having an axially-extending key, the radially outwardly facing surface having a first portion, a second portion, and a step between the first and second portions, the first portion insertable in the casing bore and threadedly attachable to the casing, the step having an axially-extending outwardly-facing first surface having an outer diameter less than the inner diameter of the casing bore and a radially outwardly-extending second surface having an outer diameter greater than the inner diameter of the casing bore and less than the outer diameter of the casing;

a drill-bit having a bit shank with an outer diameter and a bit head, the bit shank having a first portion in the chuck bore, a second portion, and a radially outwardly-extending bit shoulder between the first and second portions, the first portion having at least one axially-extending keyway engageable with the key of the chuck, the bit shoulder having an outer diameter greater than the outer diameter of the bit shank; and a substantially tubular retainer having a split retainer sidewall, a first end and a second end, the split retainer sidewall having a radially inwardly facing surface around the second portion of the chuck and around the bit shoulder, the first end having a radially inwardly-extending retainer shoulder with an axially-extending first lip forming a split retainer collar having an outer diameter less than the inner diameter of the casing bore and an inner diameter greater than the outer diameter of the first surface of the step, the split retainer collar around the first surface of the step, the second end having a radially inwardly-extending second lip forming a split retainer ring having an inner diameter less than the outer diameter of the bit shoulder, the second lip having a retainer surface at an acute angle relative to the radially inwardly facing surface of the split retainer sidewall, the split retainer ring around the second portion of the bit shank.

* * * * *